US009243650B2

(12) United States Patent
Elsner

(10) Patent No.: US 9,243,650 B2
(45) Date of Patent: Jan. 26, 2016

(54) FIN ARRAY FOR USE IN A CENTRIFUGAL FAN

(76) Inventor: Steven C. Elsner, Tonopah, AZ (US)

( * ) Notice: Subject to any disclaimer, the term of this patent is extended or adjusted under 35 U.S.C. 154(b) by 987 days.

(21) Appl. No.: 13/355,327

(22) Filed: Jan. 20, 2012

(65) Prior Publication Data

US 2012/0114474 A1 May 10, 2012

Related U.S. Application Data

(63) Continuation-in-part of application No. 11/545,210, filed on Oct. 10, 2006, now Pat. No. 8,104,306.

(60) Provisional application No. 60/725,559, filed on Oct. 11, 2005.

(51) Int. Cl.

| | |
|---|---|
| ***F04D 29/58*** | (2006.01) |
| ***F24F 1/00*** | (2011.01) |
| ***F28D 9/00*** | (2006.01) |
| ***F28D 9/04*** | (2006.01) |

(52) U.S. Cl.

CPC ..... *F04D 29/582* (2013.01); *F24F 1/0007* (2013.01); *F24F 1/0022* (2013.01); *F24F 1/0059* (2013.01); *F28D 9/0012* (2013.01); *F28D 9/04* (2013.01)

(58) Field of Classification Search

CPC ..... F28D 9/04; F28D 7/0066; F28D 7/0083; F24F 1/0007; F24F 1/0022; F24F 1/0059; F04D 29/58; F04D 29/582; F04D 29/5806; F04D 29/5853; F04D 29/5813; F04D 29/584

USPC ..... 417/366, 367, 368, 372; 62/140, 141

See application file for complete search history.

(56) References Cited

U.S. PATENT DOCUMENTS

| | | | | | |
|---|---|---|---|---|---|
| 2,454,654 | A | * | 11/1948 | Kaufman | 62/285 |
| 3,788,281 | A | * | 1/1974 | Van Lookeren Campagne R | 122/7 |
| 3,973,718 | A | * | 8/1976 | Deschamps | 228/183 |
| 4,321,803 | A | * | 3/1982 | Smith | 62/507 |
| 4,479,366 | A | | 10/1984 | Lanier et al. | |
| 4,615,176 | A | * | 10/1986 | Tippmann | 62/62 |
| 4,698,979 | A | | 10/1987 | McGuigan | |
| 5,186,022 | A | * | 2/1993 | Kim | 62/515 |
| 5,317,884 | A | * | 6/1994 | Lyon | 62/507 |
| 5,383,337 | A | | 1/1995 | Baker | |
| 5,568,835 | A | * | 10/1996 | LaCount et al. | 165/140 |
| 5,893,705 | A | * | 4/1999 | Khan et al. | 417/354 |
| 6,145,479 | A | * | 11/2000 | Rotter | 123/41.49 |
| 6,298,677 | B1 | | 10/2001 | Bujak, Jr. | |
| 6,485,547 | B1 | | 11/2002 | Iijima | |
| 6,519,966 | B1 | | 2/2003 | Martin, Sr. | |
| 6,574,975 | B2 | | 6/2003 | Bourne et al. | |
| 6,651,455 | B1 | | 11/2003 | Yoho, Sr. | |
| 6,666,038 | B1 | | 12/2003 | Hynes | |
| 6,877,315 | B2 | * | 4/2005 | Clark et al. | 60/517 |
| 6,907,663 | B2 | * | 6/2005 | Yoon et al. | 29/890.035 |
| 7,299,861 | B2 | * | 11/2007 | Lo | 165/125 |
| 8,104,306 | B1 | | 1/2012 | Elsner | |
| 2001/0045271 | A1 | | 11/2001 | Li | |
| 2002/0172588 | A1 | * | 11/2002 | Ikeda et al. | 415/53.1 |
| 2003/0094011 | A1 | | 5/2003 | Zakryk et al. | |
| 2003/0136413 | A1 | | 7/2003 | Johnson et al. | |
| 2003/0209030 | A1 | | 11/2003 | Nishida et al. | |
| 2007/0246199 | A1 | * | 10/2007 | Lee et al. | 165/122 |

FOREIGN PATENT DOCUMENTS

| | | | |
|---|---|---|---|
| FR | EP0036213 A1 | * | 9/1981 |
| JP | 02-195175 A | | 8/1990 |

OTHER PUBLICATIONS

USPTO; Non-Final Office Action mailed Nov. 26, 2008 in U.S. Appl. No. 11/545,210.

USPTO; Non-Final Office Action mailed Aug. 17, 2009 in U.S. Appl. No. 11/545,210.

USPTO; Final Office Action mailed Mar. 5, 2010 in U.S. Appl. No. 11/545,210.

USPTO; Advisory Action mailed May 5, 2010 in U.S. Appl. No. 11/545,210.

USPTO; Non-Final Office Action mailed Mar. 25, 2011 in U.S. Appl. No. 11/545,210.

USPTO; Notice of Allowance mailed Sep. 28, 2011 in U.S. Appl. No. 11/545,210.

* cited by examiner

*Primary Examiner* — Frantz Jules
*Assistant Examiner* — Nelson Nieves
(74) *Attorney, Agent, or Firm* — Snell & Wilmer L.L.P.

(57) ABSTRACT

A heat exchanger including an array of tubes and fins is configured to reside in a centrifugal fan enabling the centrifugal fan to operate as a cooling and or heating source.

19 Claims, 18 Drawing Sheets

FIN ARRAY FOR USE IN A CENTRIFUGAL FAN

RELATED APPLICATIONS

This application is a continuation-in-part of, and claims priority to U.S. Ser. No. 11/545,210 filed on Oct. 10, 2006 and entitled "FREEZABLE SQUIRREL CAGE EVAPORATOR", which is a continuation-in-part of U.S. Provisional Application Ser. No. 60/725,559 filed Oct. 11, 2005. All of which are incorporated herein by reference in their entirety.

TECHNICAL FIELD

The present invention relates to heat exchangers used in a centrifugal fan operable in cooling or heating systems.

BACKGROUND OF INVENTION

A centrifugal fan also referred to as a blower fan or squirrel-cage fan is a mechanical device which brings a fluid, frequently air, into an inlet surrounding the axis of a fan wheel. The wheel forces the air out into the fan housing, creating increased pressure in the air. The air then exits though an outlet on the fan housing. Centrifugal fans have numerous applications including heating and cooling systems, and more specifically including swamp coolers. While centrifugal fans are common, compact solutions using a centrifugal fan as a heating, cooling, and/or refrigeration source are not.

SUMMARY OF THE INVENTION

As set forth in the detailed description, in accordance with various aspects of the present invention, devices and systems for heating and cooling with a centrifugal fan is disclosed. A device in accordance with the present invention generally comprises a tube and fin array in a centrifugal fan configured to operate as a heating, cooling, and/or refrigeration source.

In one embodiment, a centrifugal fan may comprise tubes and fins configured to exchange heat with air being moved by the fan. The tubes and fins may form a portion of the outer housing of the centrifugal fan. The fins may extend into the path of the air flow. The fins may be parallel with the air flow.

In another embodiment, a heat exchanger for use in a centrifugal fan may have, a housing, a fan wheel, an air entrance, and an air exit. The heat exchanger may comprise a plurality of tubes and a plurality of fins forming a shape similar to an exterior housing of the centrifugal fan. The plurality of tubes may be on an outside edge of the fins following the shape similar to an outer wall of the housing. An inside edge of the plurality of fins may be configured to substantially follow an outer circumferential profile of the fan wheel.

In another embodiment, a fin array for use in a centrifugal fan may have a housing and a fan wheel. The array may comprise a first tube, a second tube, and a fin. The fin may have a first end and a second end. The first tube and the second tube may be in parallel contact with the fin along most of the fin's length. The fin may be sandwiched between the first tube and the second tube. The fin, first tube, and the second tube may be substantially annular about an axis of the fan wheel. The first tube and the second tube may be biased toward an edge of the fin farthest from the centrifugal fan wheel.

Further objects and advantages will become apparent as the following description proceeds and the features of novelty which characterize this invention will be out pointed with particularity in the claims annexed to and forming a part of this specification.

BRIEF DESCRIPTION OF THE DRAWINGS

The subject matter of the invention is particularly pointed out and distinctly claimed in the concluding portion of the specification. The invention, however, both as to structure and method of operation, may best be understood by reference to the following description taken in conjunction with the claims and the accompanying drawing figures, in which like parts may be referred to by like numerals.

DETAILED DESCRIPTION

Figure 1:
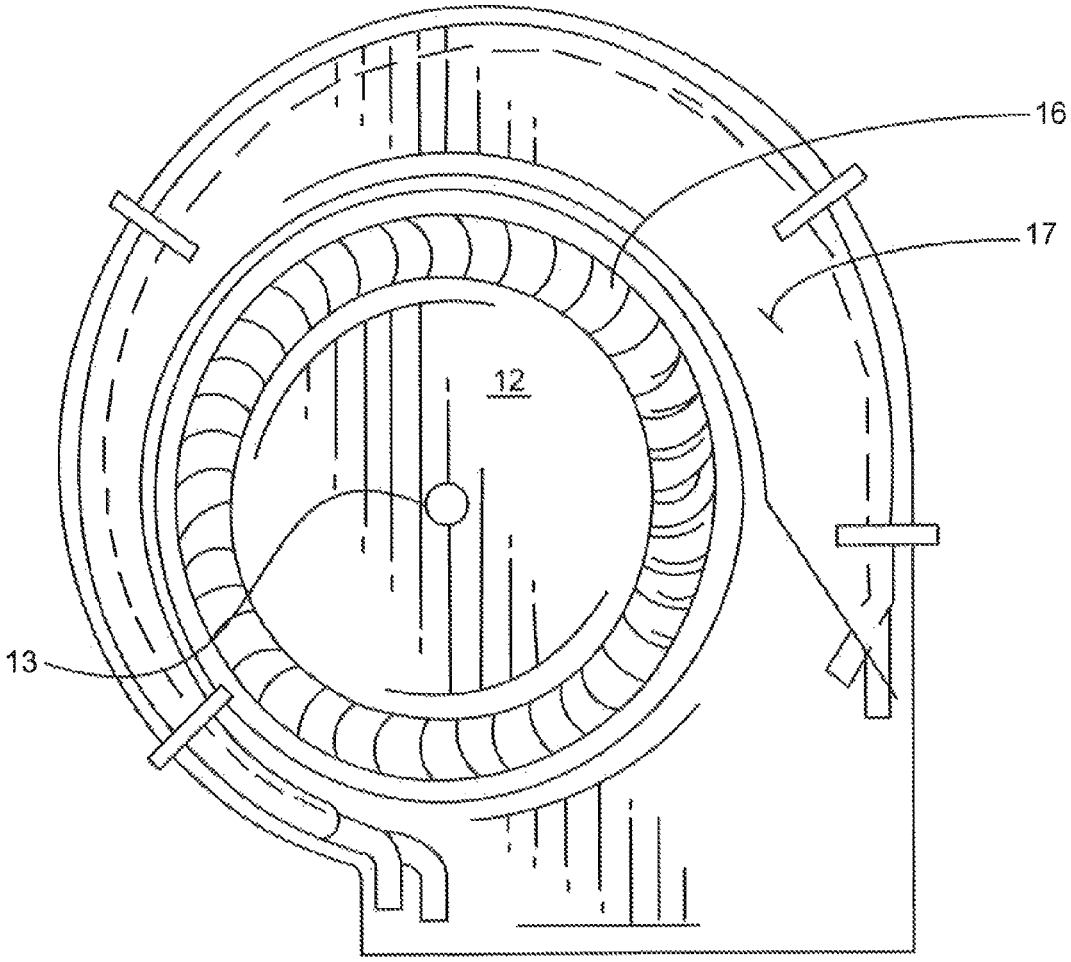
FIG. 1 is the open end view of the squirrel cage fan evaporator in accordance with the present invention in accordance with an exemplary embodiment of the present invention.

The detailed description herein makes use of various exemplary embodiments to assist in disclosing the present invention. While these exemplary embodiments are described in sufficient detail to enable those skilled in the art to practice the invention, it should be understood that other embodiments may be realized and that modifications of structures, arrangements, applications, proportions, elements, materials, or components used in the practice of the instant invention, in addition to those not specifically recited, can be varied or otherwise particularly adapted to specific environments, manufacturing specifications, design parameters or other operating requirements without departing from the scope of the present invention and are intended to be included in this disclosure. Thus, the detailed description herein is presented for purposes of illustration only and not of limitation.

In accordance with an aspect of the present invention, a centrifugal fan may be configured as a heating or cooling system for a fluid such as air. While all fluids understood by a person of ordinary skill in the art to be operable with a centrifugal fan are contemplated herein, air is described as one particular example throughout. In accordance with an embodiment of the present invention, the centrifugal fan may include a heat exchanger that is configured to heat or cool air passing through the centrifugal fan. For example, the heat exchanger may run a fluid colder than the air pulled into the centrifugal fan, allowing the air to lose its heat to the colder fluid. In another example, the heat exchanger may run a fluid warmer than the air pulled into the centrifugal fan allowing the air pulled into the centrifugal fan to absorb the heat from the warmer fluid in the heat exchanger. In another example, the heat exchanger may be configured to operate separate tubes within the heat exchanger independently. For example, the heat exchanger may run multiple fluids simultaneously throughout the heat exchanger. The heat exchanger may also be configured to operate various tubes in multiple cycles. For example, the heat exchanger may run cold fluid in one cycle then warm fluid in a second cycle. The heat exchanger may also be configured to operate separate tubes independently while operating multiple cycles. For example, the heat exchanger may run both warm and cold fluids at the same time. The decision to run warm fluid, cold fluid, or both may be based on the desire to control various factors. The factors may include temperature, humidity, and/or ice buildup. In another example, the multiple fluids may include different types of fluids such as a refrigerant (e.g. R404), water, air, and/or any fluid recognized as beneficial by one of ordinary skill in the art. The heat exchanger may allow different types of fluids to be run at different temperatures and different physical states. For example, liquid refrigerant may be used in conjunction with gaseous water (i.e. steam). As the heat exchanger may be configured to operate separate tubes independently in multiple cycles, any combination of fluids run under any combination of different physical parameters is contemplated herein.

In accordance with an aspect of the present invention, the heat exchanger in the centrifugal fan may be a fin and tube array comprising one or more fins and one or more tubes. In accordance with an exemplary embodiment, at least one fin and tube may be in parallel contact along a signification portion of the fin's length. For example, the fin and tube may be in parallel contact along 50% or more of the fins length. In accordance with various embodiments, the fin may be sandwiched between the two tubes. The fins may extend into the path of the air flow, configured such that the fins are parallel with the air flow coming out of the fan wheel. In this position, the fins and the tubes may be substantially annular about an axis of the fan wheel, meaning the axis of the fan wheel is perpendicular to the plane defined by the larger surface (i.e. the surface with the greatest surface area) of the fins. The tubes may be biased toward the fin edge which is farthest from the centrifugal fan wheel.

In accordance with various embodiments, the one or more fins in the array may be perpendicular to and wrap around a portion of an axis of a centrifugal fan wheel. The outside of the array may approximate the shape of the housing of the centrifugal fan. The array may form part of or all of the outer housing of the centrifugal fan. For example, the fins and tubes may be stacked in an arrangement such that the fins and tubes form a contiguous outer wall of the centrifugal fan. In one example, the array may be manufactured by extruding the fins and tubes in a curved shape approximating a portion of the outer wall of the centrifugal fan.

In one example, the array may comprise a plurality of fins and tubes stacked in a continuing pattern of tube, fin, tube, fin. The continuing pattern may begin with either the tube or the fin. In accordance with the aspects and embodiments discussed above, each tube on either side of the fin may contain a different type and/or physical state of fluid.

In accordance with various embodiments of the present invention, the array may be configured such that the one or more fins occupy a space between an exterior of the centrifugal fan wheel and the centrifugal fan housing. In one example, the fan wheel may not be centered in the housing and in response the fin may be narrow on one end and progressively widens to the second end. Similarly the space between the housing and the wheel may be a different dimension than the height of the opening; accordingly, the fin may be dimensioned so it substantially fills each space, resulting in a changing height of the fin. In one example, the height of the second end of the fin may be substantial the same height as the vertical height of the exit of the centrifugal fan housing. In various embodiments, the fin height at the exit may be less than the full height of the exit but greater than half the height of the exit. Alternatively in other embodiments, the fin height at the exit may be less than half the height of the exit.

In accordance with an aspect of the invention, the array may be plumbed such that it is configured to operate the separate tubes independently and/or operate the separate tubes in multiple cycles. In accordance with one embodiment, the array may be configured with a switching flow. In a switching flow, a fluid may flow through at least one tube in different direction in response to different cycles. For example, in a first cycle the fluid may flow from a first end to a second end of a tube. In a second cycle the fluid may flow from the second end to the first end of the tube. In accordance with another embodiment, the array may be configured with an opposing flow. In an opposing flow, fluid may flow through a first tube in the opposite direction as compared to fluid flowing in a second tube. In accordance with another embodiment, the array may be configured with an alternating flow. In an alternating flow, fluid may flow in one tube in one cycle then in the next tube in a different cycle. In accordance with another embodiment, the array may be configured to operate in accordance with one or more of an alternating flow, an opposing flow, and a switching flow.

In accordance with another embodiment, the array may be plumbed such that each tube may run more than one fluid. For example, a tube may have a three way valve prior to entry into the arrays. The three way valve may switch fluid sources operating in the tube. In one example, one line connecting into the array tube may be a cooled refrigerant coming from the throttling valve (or similar step in the refrigeration process), whereas the second line connecting into the array tube may be a heated refrigerant coming from a compressor (or similar step in the refrigeration process). Thus refrigerant from multiple steps in the refrigeration process can be routed through the array. In various embodiments, liquids from different sources such as water and refrigerant may be routed through the array tube via the three way valve. While many embodiments are discussed using a three way valve, any fluid switching system that accomplishes a similar purpose is contemplated herein.

Figure 2:
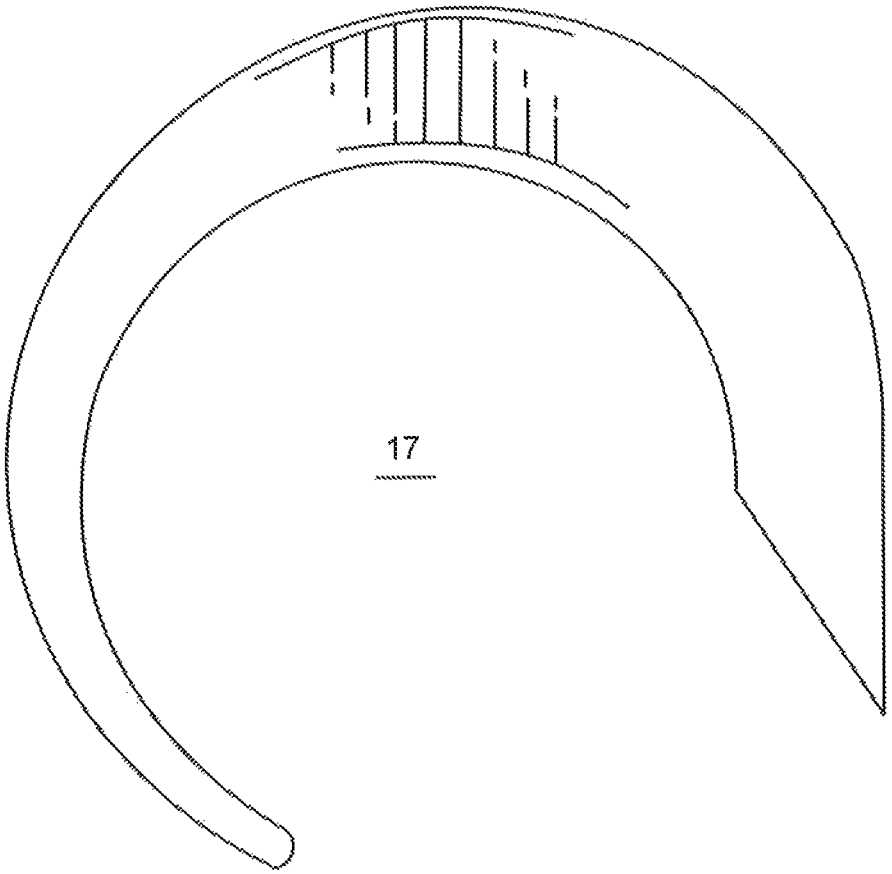
FIG. 2 is a view of one of several cooling fins used in the present invention depicted in FIG. 1 in accordance with an exemplary embodiment of the present invention.
Figure 3:
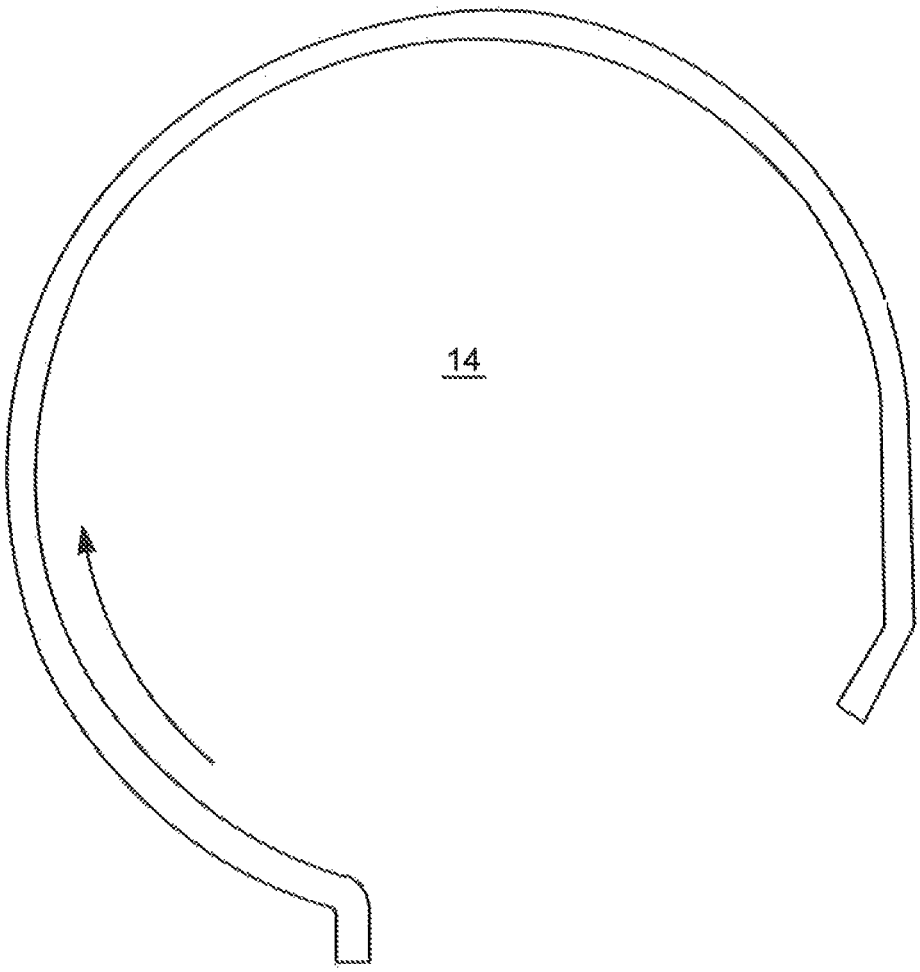
FIG. 3 is a view of the evaporator tubing of the evaporator shown in FIG. 1 showing refrigerant flow in a counterclockwise direction in accordance with an exemplary embodiment of the present invention.
Figure 4:
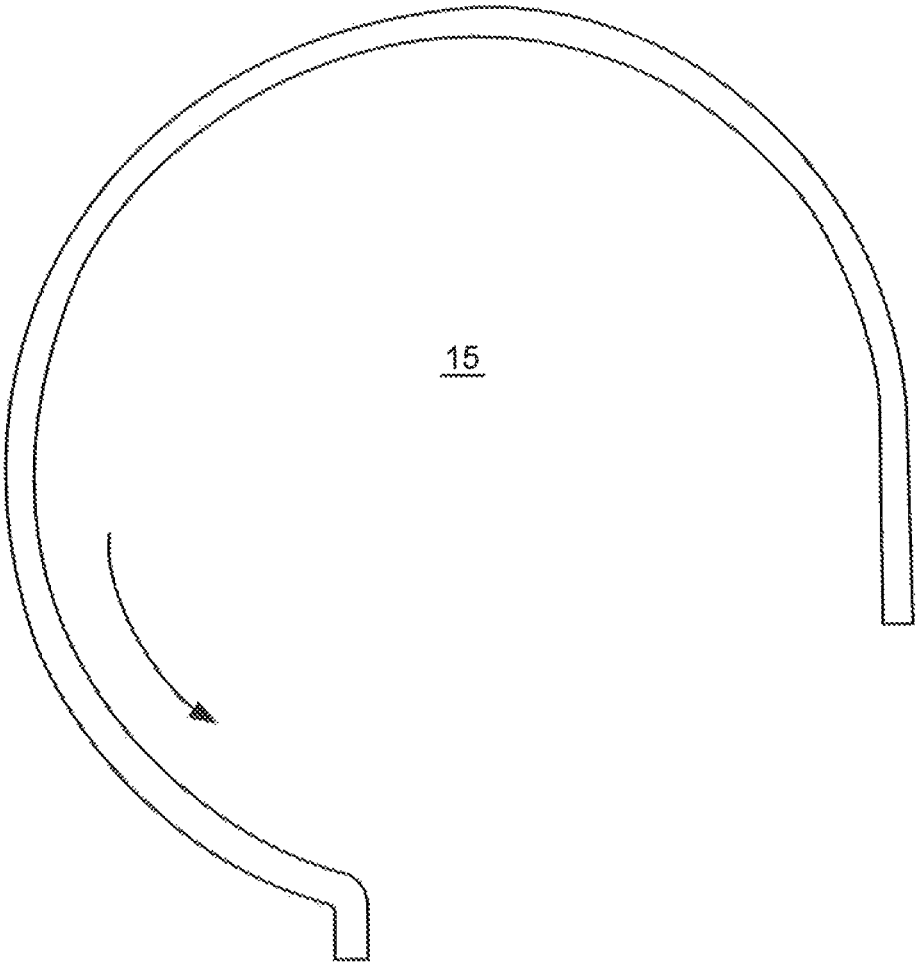
FIG. 4 is a view of the shape of the evaporator tubing of the evaporator shown in FIG. 1 showing refrigerant flow in a clockwise direction in accordance with an exemplary embodiment of the present invention.
Figure 5:
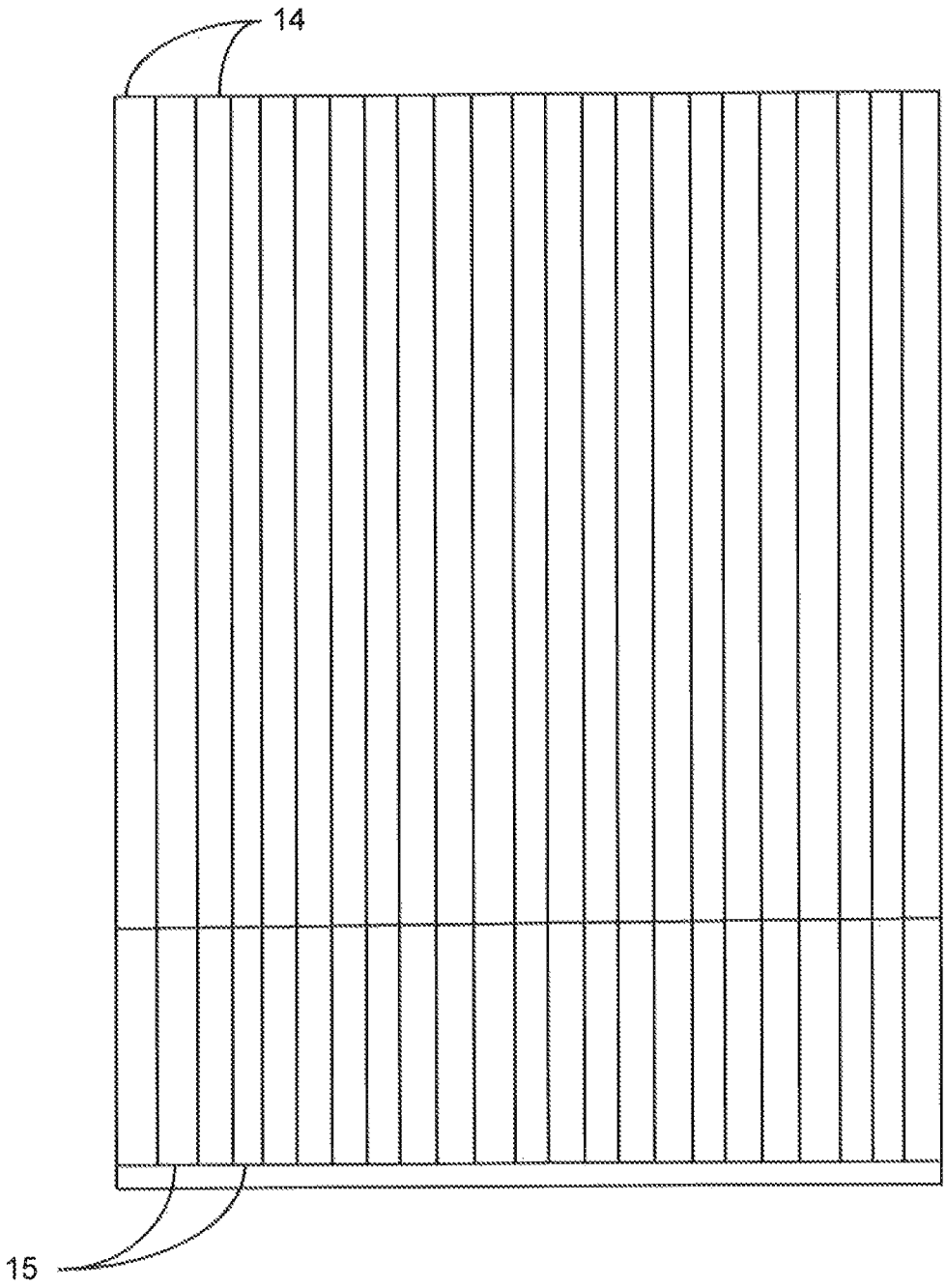
FIG. 5 is the side view of the squirrel cage fan evaporator showing the evaporator tubing separated by fins also showing liquid and suction connections to evaporator tubing in accordance with an exemplary embodiment of the present invention.
Figure 6:
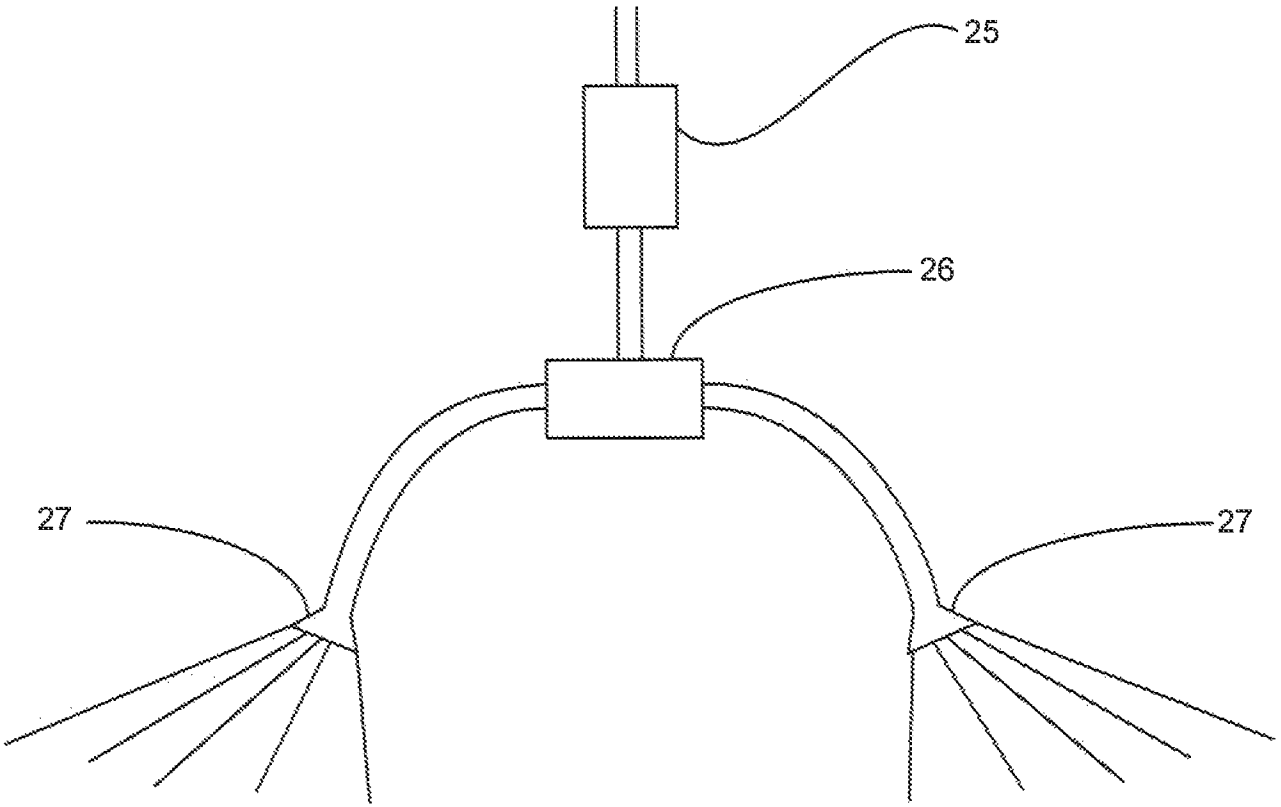
FIG. 6 is a schematic drawing of the metering device reversing valve diffuser tubing going to the evaporator in accordance with an exemplary embodiment of the present invention.

In accordance with various embodiments, the array may be incorporated into a refrigeration system as an evaporator. As shown in the attached FIGS. 1 through 7, the present invention provides a squirrel cage evaporator having a centrifugal fan wheel 12 with alternating refrigerant cooling coils 14, 15 encircling and comprising the outside diameter of the centrifugal fan wheel 12. The centrifugal fan wheel 12 includes an electric motor 13 having many mounting characteristics known in the art. As shown in FIG. 2, fins 17 divide each of the reversing flow refrigerant evaporator coils 14, 15. This configuration is such that cooling fins 17 separating coils 14, 15 increases the service area of evaporator thereby allowing evaporator to be partially frozen in the direction of the refrigerant flow, which will defrost on a reverse cycle in every other tube as described in more detail below.

Figure 7:
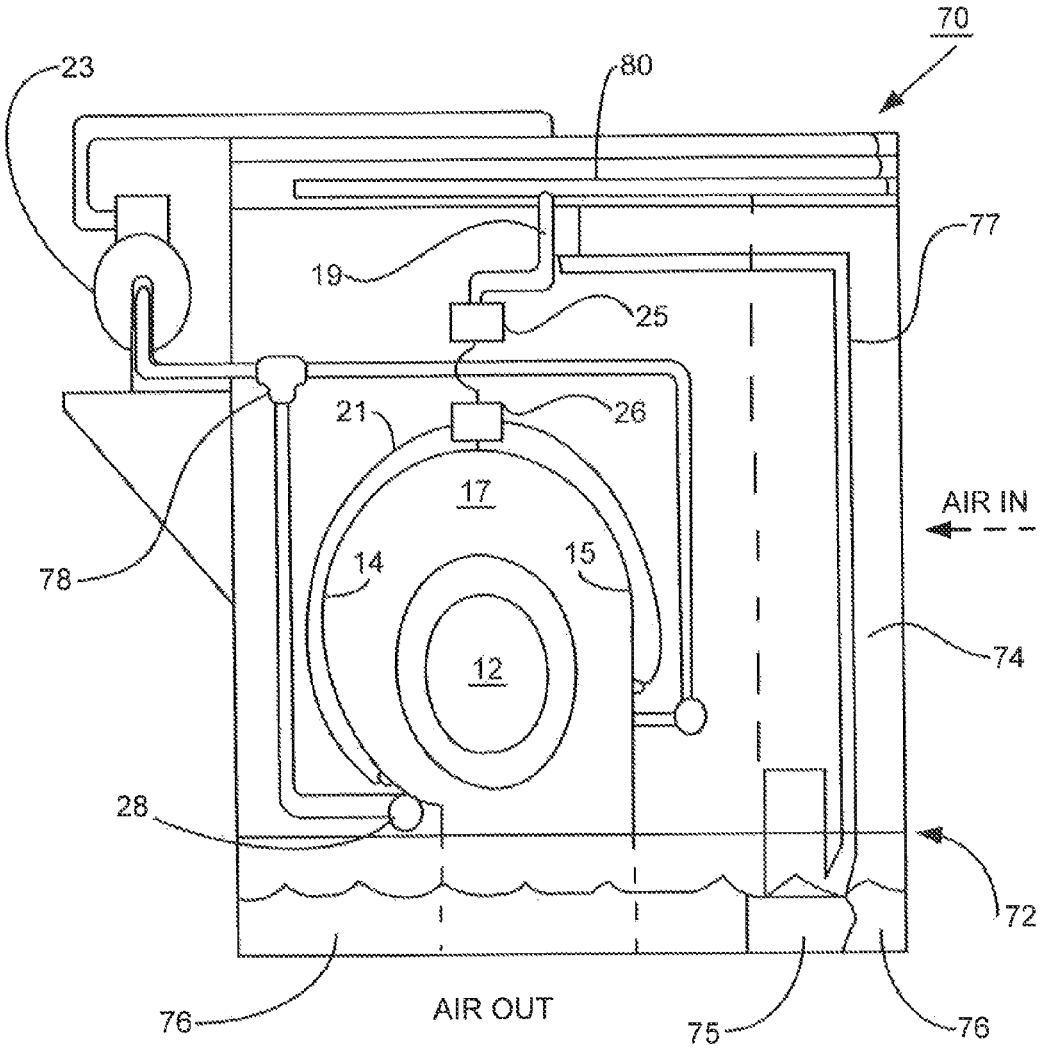
FIG. 7 is a side cross section view showing the squirrel cage evaporator positioned inside the evaporative cooler in accordance with an exemplary embodiment of the present invention.

In accordance with one exemplary embodiment, of the invention, as shown in FIG. 7, a liquid line 19 leaves a condenser 80 having a filter-drier and sight glass all known in the art and supplying a metering device 25 at which point the liquid converts to a gas known in the art as "flashing". Liquid line 19 continues to a reversing valve 26 supplying flow in opposite directions through a plurality of diffusers 27 to supply each evaporator coil 14, 15 with its own supply of refrigerant.

In more detail, squirrel cage evaporator with its opposing flow of refrigerant when applied to an evaporative cooler 70 known in the art adds to the cooling capabilities of said cooler 70 by dehumidifying the air passing over partially freezing evaporative coils 14, 15. With evaporative coils 14, 15 freezing in alternating directions a frost pattern will alternate between one set of coils allowing the other set of coils not supplied to defrost. The condensing water, known in the art as condensate, moves along the radius forced by the velocity of the air to exit fins 17 and is directed via conduit 28 to a tank 76 of the evaporative cooler 70 thereby providing a large portion of the humidity as condensation to tank 76.

In a cooling embodiment, as air is blown over fin 17, heat is removed from evaporative coils 14, 15 via convective cooling. The present invention is suitable for use with many refrigerants, including but not limited to, R404 refrigerant which has a −40° F. expansion point. When evaporator reaches the end of a pre-determined cycle of circulating refrigerant, ice starts to accumulate on the evaporator coils 14, for example. Reversing valve 26 switches flow to evaporative coils 15 thereby beginning to circulate refrigerant in the opposite direction of coils 14. At the next end of the pre-determined cycle, reversing valve 26 switches flow direction again to provide refrigerant to coils 14 again. By cycling the flow of refrigerant between coils 14, 15, the evaporative coils 15, 14 are allowed to thaw and therefore any accumulation of ice is prevented. This is an example of the switching flow described above.

Evaporative coils 14, 15 are parallel to one another and, preferably, made of metal though those skilled in the art will recognize that other materials may be suitable for use. In the metal embodiment, coils 14, 15 and fins 17 are made of aluminum. Furthermore, fins and coils may comprise any suitable materials. In the preferred embodiment, evaporative coils 14, 15 are in contact with fins 17 separating each coil 14 from an adjoining coil 15. In the presently preferred embodiment, reversing valve 26 which is also known as a three way solenoid, is utilized to achieve the alternating flow.

Figure 8:
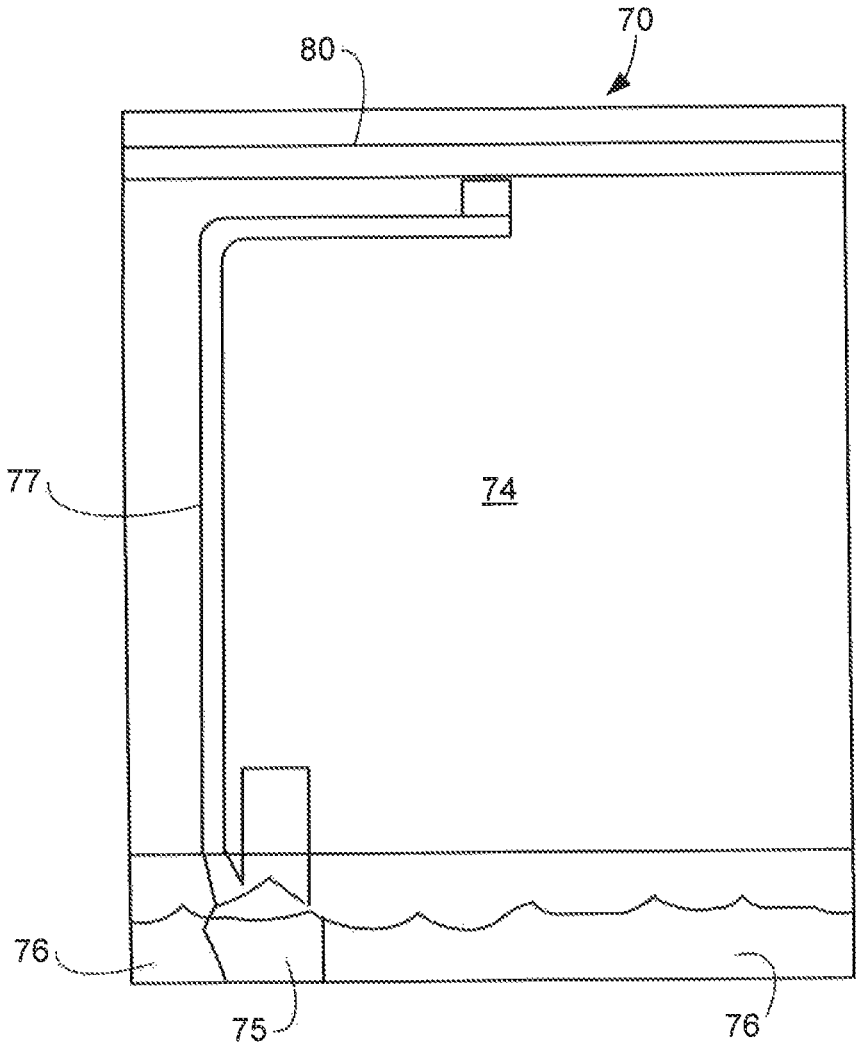
FIG. 8 is an end view of the evaporative cooler with air intake through evaporative pad also showing location of water pump and tubing to a water cooled condenser in accordance with an exemplary embodiment of the present invention.
Figure 9:
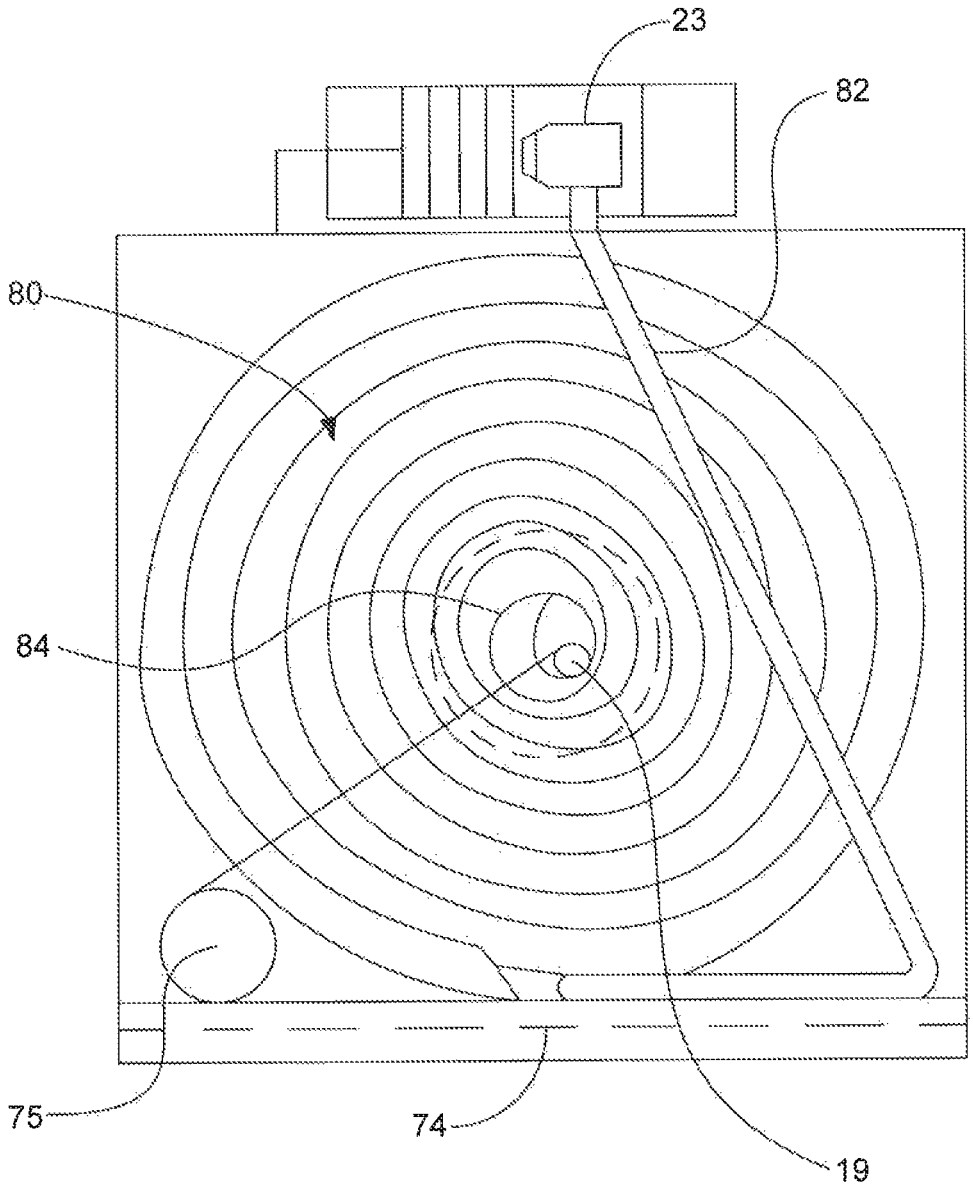
FIG. 9 is a view of the top with the scroll shaped water channel with condenser submerged in water, known in the art as water-cooled condenser.
Figure 10:
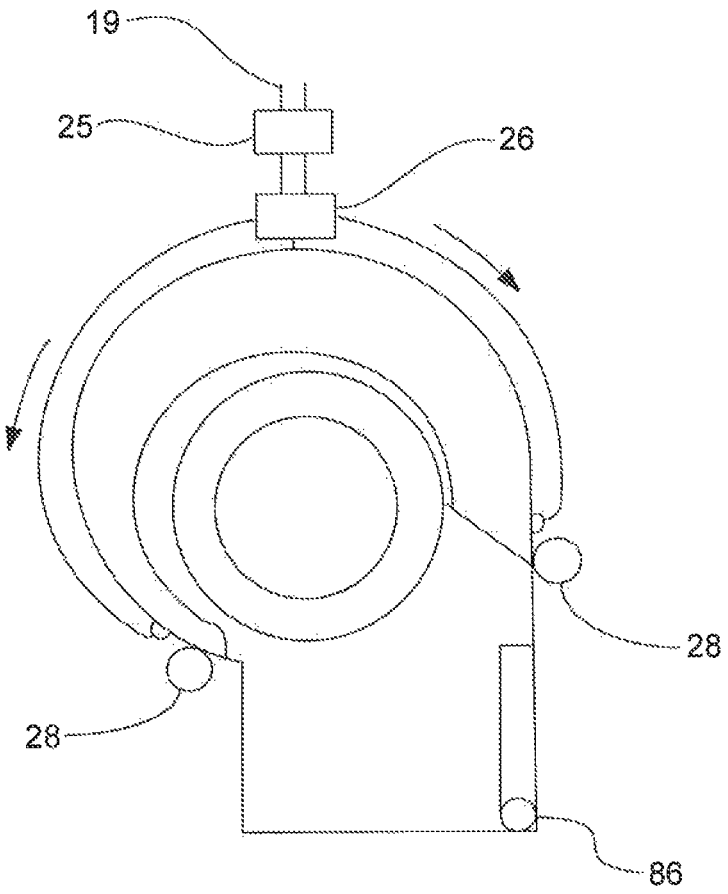
FIG. 10 is a close up view of the squirrel cage fan of FIG. 7.
Figure 11:
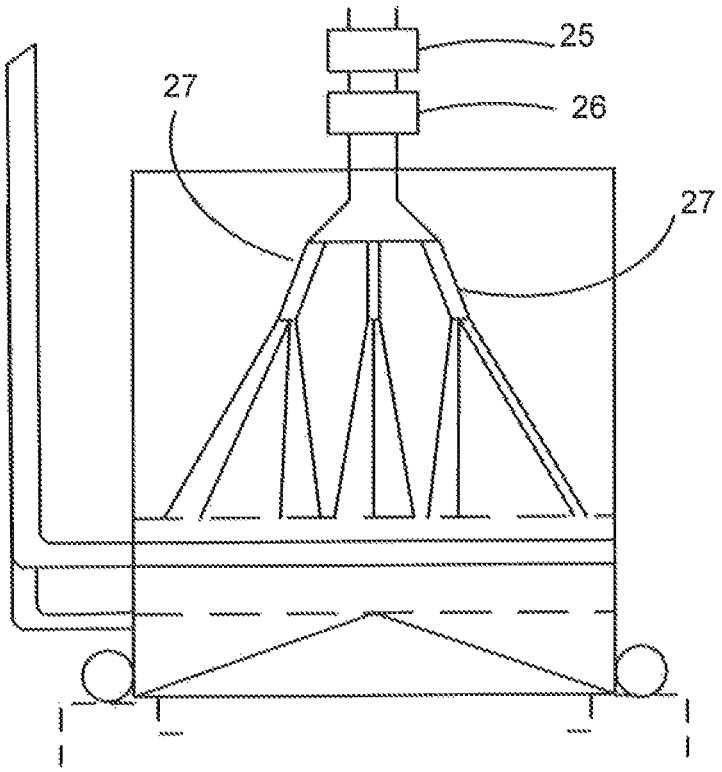
FIG. 11 is a schematic view of the metering valve, reversing valve and conduit of FIG. 7.

Turning now to FIGS. 7-9, an evaporative cooler 70 is shown which employs an exemplary embodiment of the present invention. As shown, evaporative cooler 70 provides a box like housing 72 having an evaporative pad 74 comprising one side thereof. Evaporative pad 74 is generally a wet cardboard material which allows air to pass therethrough. As the air passes therethrough, it evaporates some of the water in pad 74 and is thusly cooled. To keep pad 74 moist, the bottom of housing 70 forms a tank 76 which is filled with water, which is pumped by a water pump 75 through pipe 77 to the top of unit 70 to flow down the pad 74.

Squirrel cage fan 12 of the present invention is mounted within housing 70. The air output side of fan 12 extends downwardly through the bottom of housing 70. Squirrel cage evaporator fan 12, when operating, pulls air through pad 74 cooling and dehumidifying the air downwardly through the output side.

In an exemplary embodiment, and with reference to FIGS. 7 and 9, the suction side of evaporator coils 14, 15 are joined at fitting 78 and hence to the suction side of a compressor 23. From that point, compressor 23 condenses the refrigerant and sends it through an inlet 82 to condenser 80 mounted on top of housing 70 in liquid line 19. In the preferred embodiment, as best seen in FIG. 9, condenser 80 is in the shape of a spiral with an inlet 82 on the outer edge of the spiral down liquid line 19 from the center of the spiral positioned just above squirrel cage fan 12.

In one exemplary embodiment, condensed water from the coils will drip into tank 76 thereby providing indeterminate amount of "calcium free" water to the reservoir at the bottom of the evaporative cooler providing for a cleaner environment and longer life set of filter pads. In another exemplary embodiment, tubing 77 from a water pump 75 pumps reservoir water into the middle of the spiral of condenser 80. The water runs along condenser 80 opposite the refrigerant flow in liquid line 19 thereby providing further cooling of the refrigerant contained therein before encountering pad 74 where it drops down the front of pad 74 for cooling purposes.

Figure 12:
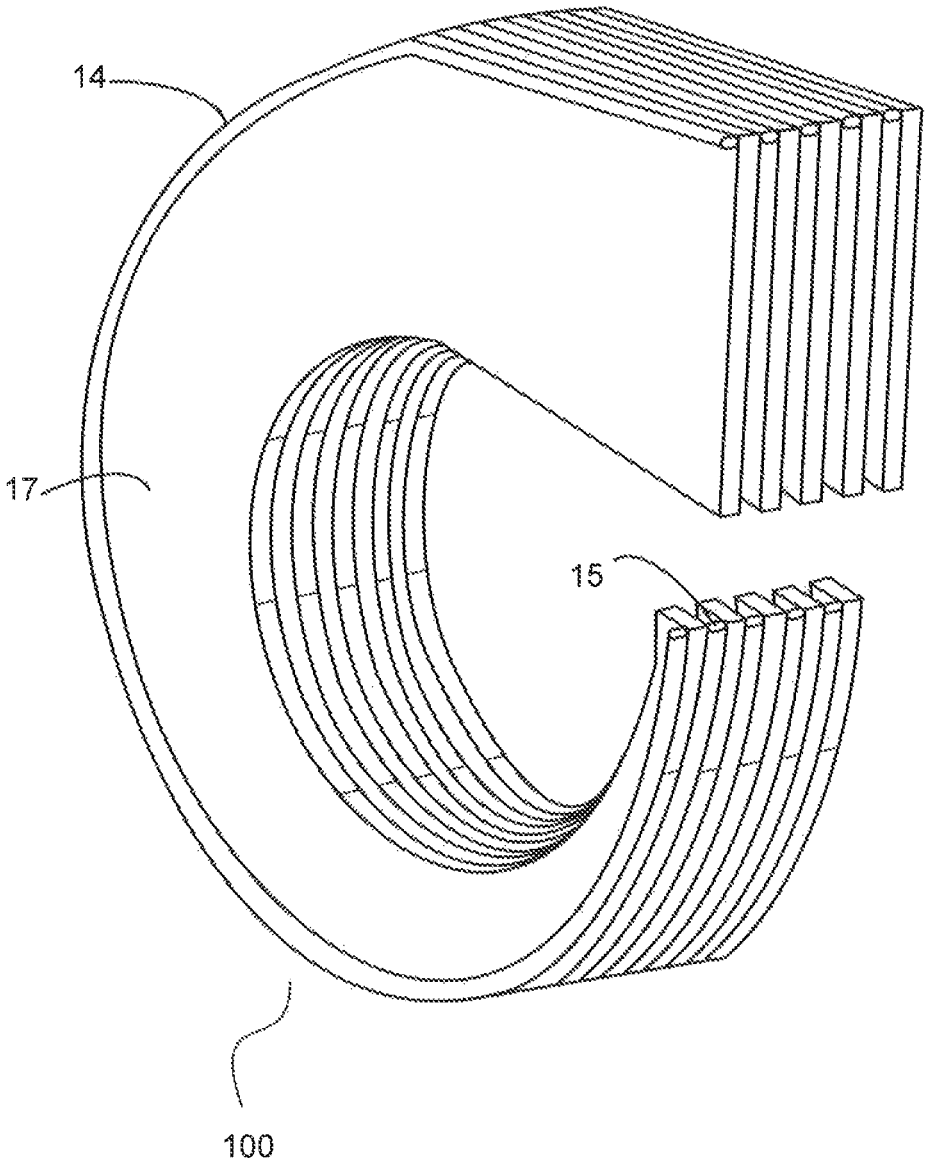
FIG. 12 is an isometric view of a fin and tube array in accordance with an exemplary embodiment of the present invention.
Figure 13:
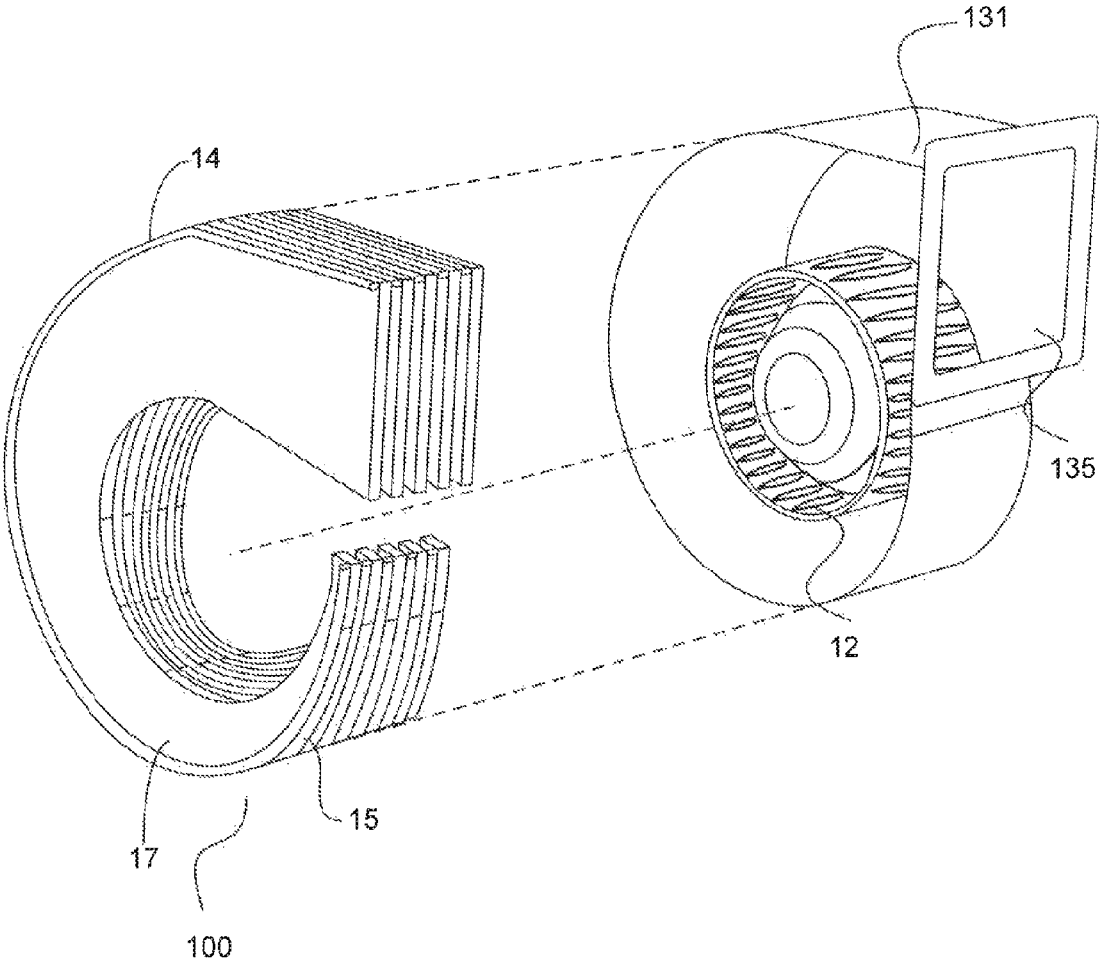
FIG. 13 is a partially exploded isometric view of a fin and tube array and an open centrifugal fan in accordance with an exemplary embodiment of the present invention.
Figure 14:
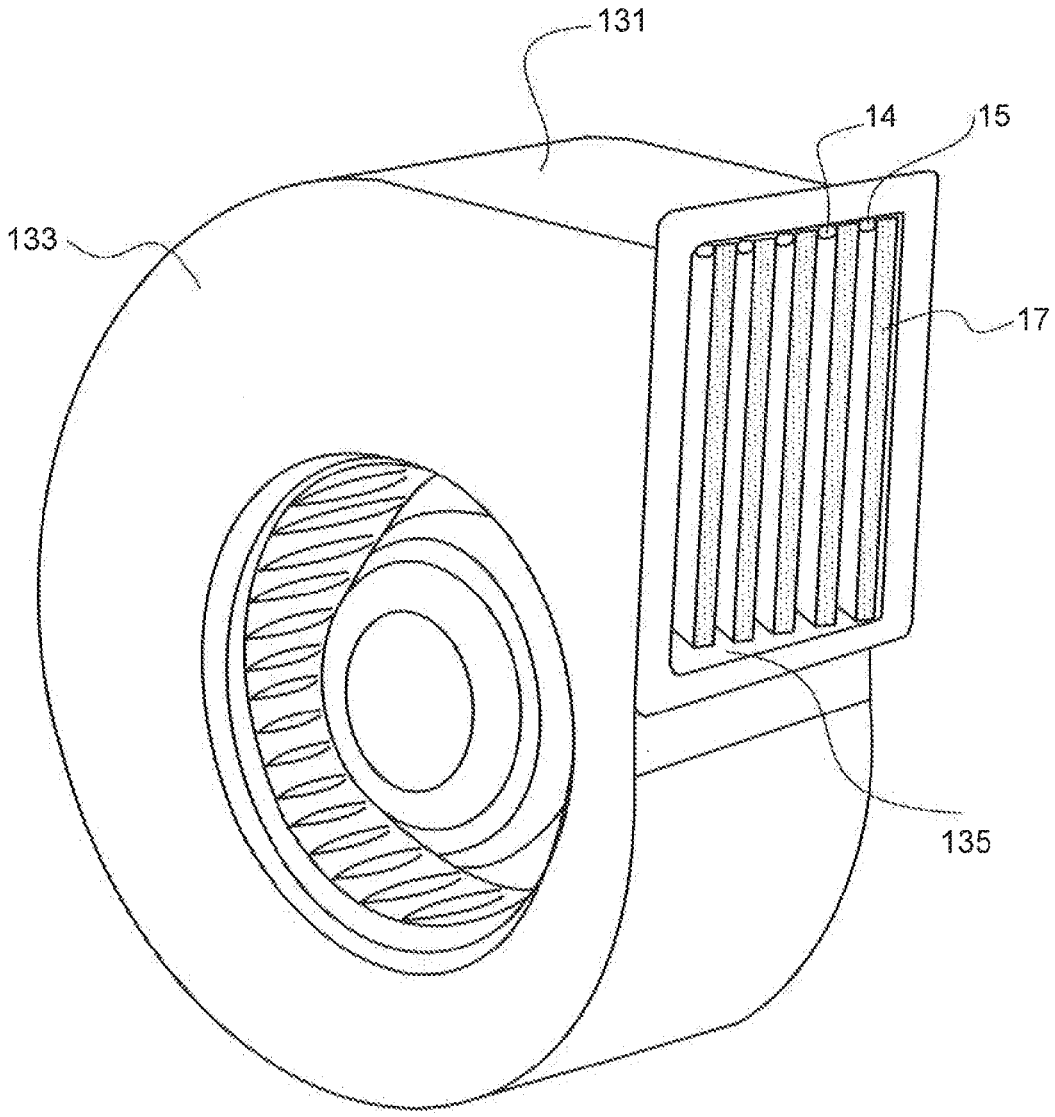
FIG. 14 is an isometric view a centrifugal fan with a fin array on the interior in accordance with an exemplary embodiment of the present invention.

In accordance with various embodiments of the invention, and illustrated in FIG. 12, tube/fin array 100 may be configured as a single assembly comprising one or more fins 17, contacting tube 14 and tube 15. The profile of the fins and tubes may be exaggerated in the figures, e.g., FIGS. 12 and 13. The fins may be any width/thickness suitable to transfer energy between tubes 14/15 and the air passing through the fins. A plurality of tubes and fins may be included in the array functioning similarly to fin 17, tube 14, and tube 15 as discussed herein. In accordance with various embodiments of the invention, and as illustrated in FIG. 13, tube/fin array 100 may be a inserted into the interior of the centrifugal fan. While FIG. 13 is shown with the centrifugal fan having outside surface 131, the system may be operated without the centrifugal fan having an outside surface. Instead, the outside surface of array 100 may function as the outside surface of the centrifugal fan. In either embodiment, array 100 may be located around fan wheel 12 allowing air to be forced from fan wheel 12 into the fins 17 along tubes 14 and 15 and out of the centrifugal fan outlet 135. As illustrated in FIG. 14, the centrifugal fan may be enclosed or partially enclosed, with tube/fin array 100 being located on the interior of the centrifugal fan shell. Tubes 14 and 15 and fins 17 may are shown through the open fan outlet 135.

Figure 15:
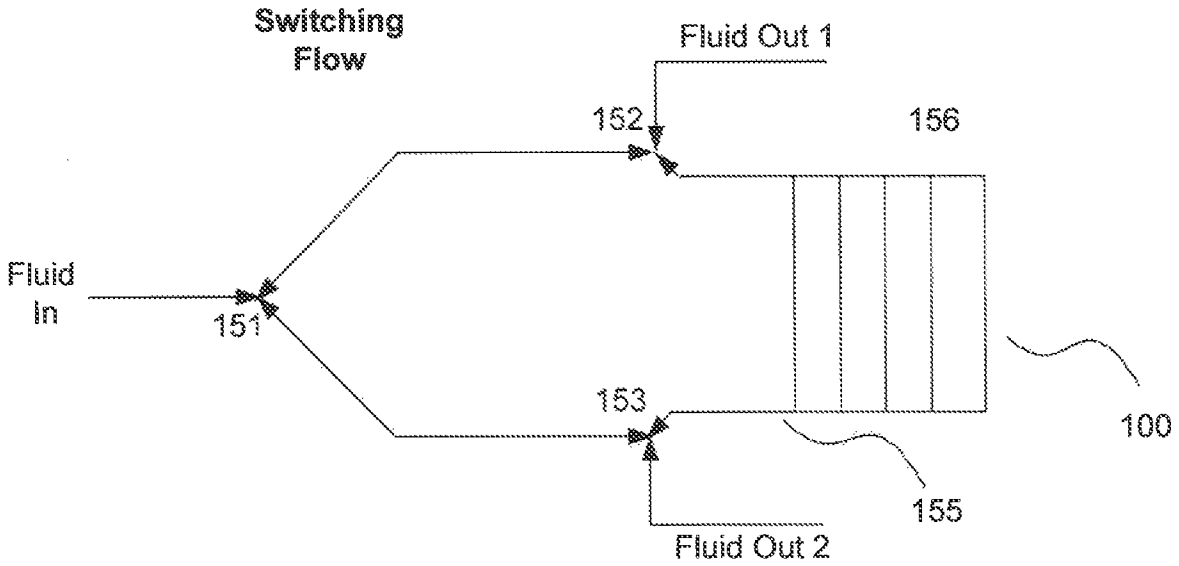
FIG. 15 is an exemplary diagram of a switching fluid flow through a tube array in accordance with an exemplary embodiment of the present invention.

In accordance with various embodiments of the invention, and illustrated in FIG. 15, tube/fin array 100 may be plumbed with a switching flow. In one example, array 100 may be connected to valves 152 and 153 on each of array 100's first end 156 and second end 155. Valves 152 and 153 may be connected to valve 151. Valves 152 and 153 may also exit fluid away from the array. In one instance, fluid may enter valve 151. Valve 151 may be configured to direct the fluid to either valve 152 or valve 153. If directed to valve 152, the fluid enters valve 152 and is directed into first end 156 of array 100 and then out second end 155 of array 100. The fluid then proceeds to valve 153 which may direct the fluid away from array 100 to fluid out 2. In a second instance, the system may be switched such that the fluid flows through the array in the other direction. For example, valve 151 may direct fluid to valve 153. Valve 153 may direct fluid into second end 155 of array 100. The fluid may exit array 100 at first end 156 and proceed to valve 152. Valve 152 may then direct fluid away from array 100 to fluid out 1. While this is only one example of switching flow, all systems for providing switching flow available to a person of ordinary skill in the art are contemplated herein.

Figure 16:
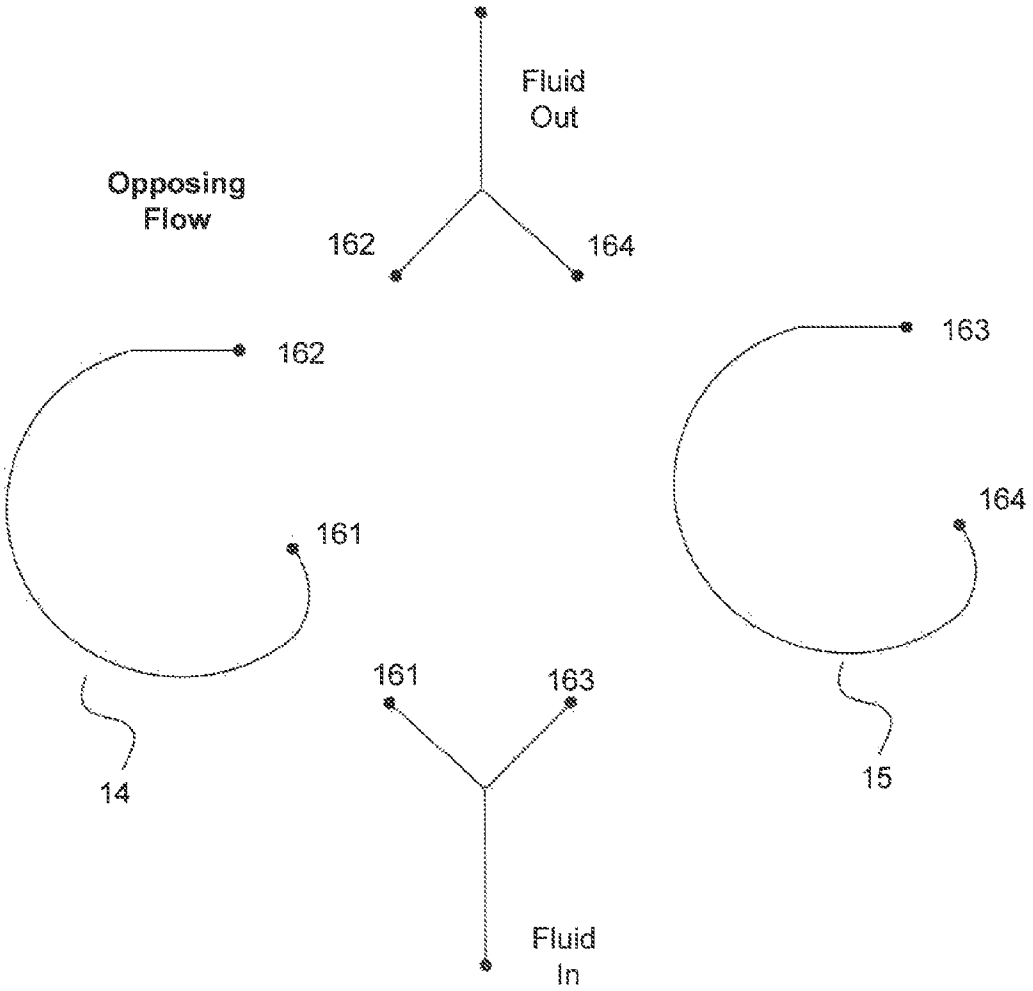
FIG. 16 is an exemplary diagram of an opposing fluid flow through a tube array in accordance with an exemplary embodiment of the present invention.

In accordance with various embodiments of the invention, and illustrated in FIG. 16, array 100 may be plumbed with an opposing flow. In one example, first tube 14 of array 100 may be connected at a first end 162 to a fluid outlet. First tube 14 may be connected at a second end 161 to a fluid inlet. Second tube 15 of array 100 may be connected at a first end 163 to a fluid inlet. Second tube 15 may be connected at a second end 164 to fluid outlet. In this configuration fluid flowing through tube 14 flows in the opposite direction of fluid flowing through tube 15. While this is only one example of opposing flow, all systems for providing opposing flow available to a person of ordinary skill in the art are contemplated herein.

Figure 17:
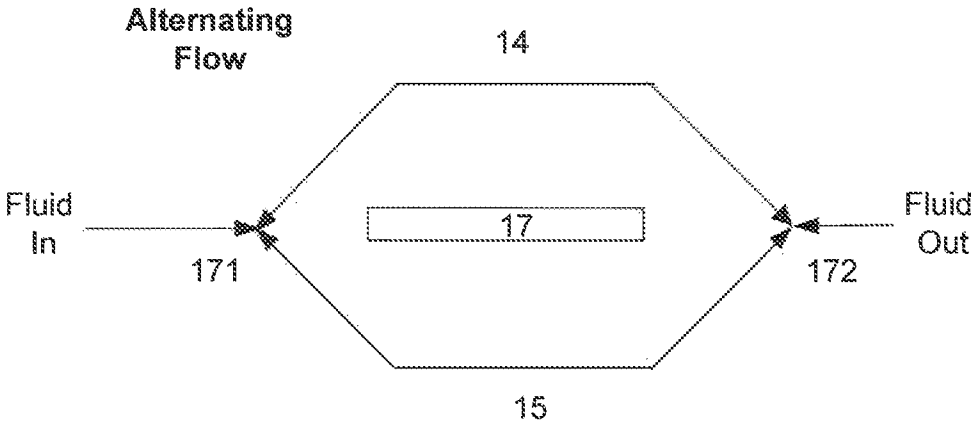
FIG. 17 is an exemplary diagram of an alternating fluid flow through a fin array in accordance with an exemplary embodiment of the present invention.

In accordance with various embodiments of the invention, and illustrated in FIG. 17, tube/fin array 100 may be plumbed with an alternating flow. In one example, first tube 14 of array 100 may be connected at a first end to valve 171. First tube 14 may be connected at a second end to valve 172. Second tube 15 may be connected at a first end to valve 171. Second tube 15 may be connected at a first end to valve 172. In this configuration fluid may enter valve 171 and be directed to either tube 14 or tube 15. In one instance, the fluid is directed to tube 14 by valve 171. The fluid may exit tube 14 at valve 172 and be directed to the fluid outlet. In a second instance, the fluid may be directed from "fluid in" to tube 15 by valve 171. The fluid may exit tube 15 at valve 172 and be directed to the fluid outlet. In this configuration fluid may alternate between two tubes. While this is only one example of alternating flow, all systems for providing alternating flow available to a person of ordinary skill in the art are contemplated herein.

Figure 18:
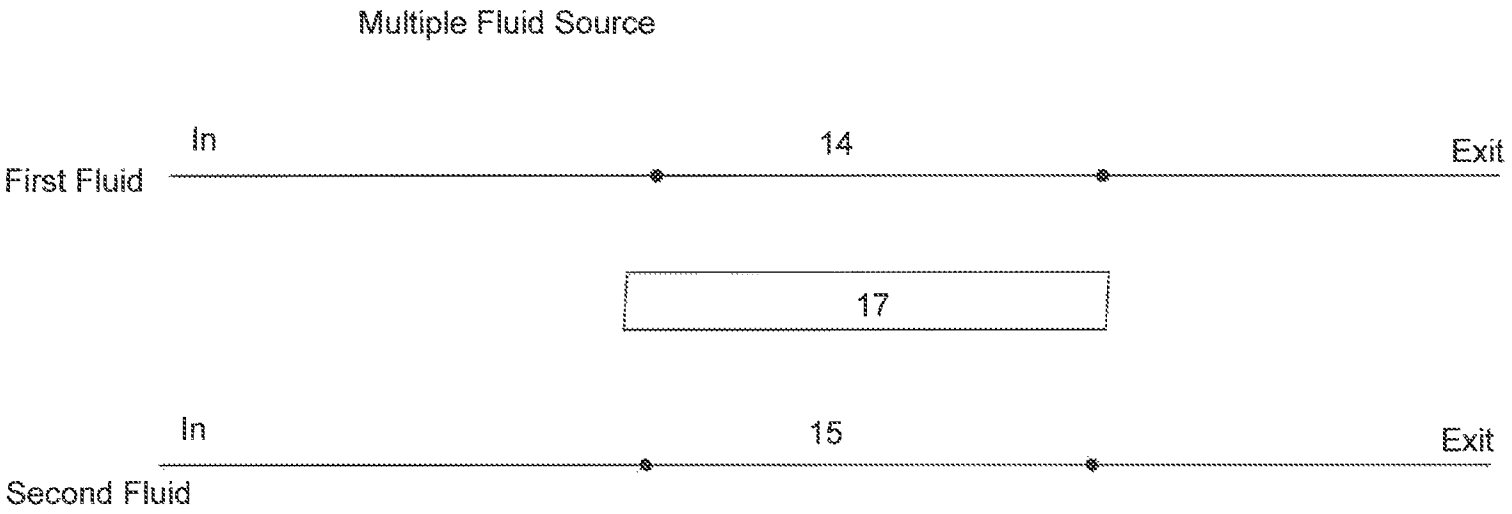
FIG. 18 is an exemplary diagram of a multiple fluid source fluid flow through a fin array in accordance with an exemplary embodiment of the present invention.

In accordance with various embodiments of the invention, and illustrated in FIG. 18, tube/fin array 100 may be plumbed with multiple fluids. For example, a first fluid source may be connected to tube 14. The fluid may enter tube 14 on a first end and exit on a second end. Similarly, a second fluid source may be connected to tube 15. In this configuration a tube array may run multiple fluids. The fluid may enter tube 15 on a first end and exit on a second end. While this is only one example of multiple fluids, all systems for providing multiple fluids available to a person of ordinary skill in the art are contemplated herein.

As discussed herein, the fin and tube array may be configured to operate in accordance with one or more of an alternating flow, an opposing flow, and a switching flow. As there are numerous combinations of these three configurations multiplied by various implementations of each, all possible combinations are not discussed and illustrated herein, Suffice it to say that based on the drawings and description provided herein, one of ordinary skill in the art can implement the various combinations and implementations.

Various principles of the present invention have been described in exemplary embodiments. However, many combinations and modifications of the above-described structures, arrangements, proportions, elements, materials, and components, used in the practice of the invention, in addition to those not specifically described, can be varied without departing from those principles. Various embodiments have been described as comprising automatic processes, but this process may be performed manually without departing from the scope of the present invention. Furthermore, the benefits, advantages, solutions to problems, and any elements that may cause any benefit, advantage, or solution to occur or become more pronounced are not to be construed as critical, required, or essential features or elements of the invention. The scope of the invention is accordingly to be limited by nothing other than the appended claims, in which reference to an element in the singular is not intended to mean "one and only one" unless explicitly so stated, but rather "one or more." All structural and functional equivalents to the elements of the above-described exemplary embodiments that are known to those of ordinary skill in the art are expressly incorporated herein by reference and are intended to be encompassed by the present claims. Further, a list of elements does not include only those elements but may include other elements not expressly listed or inherent to such process, method, article, or apparatus.

The invention claimed is:

1. A fin array for use in a centrifugal fan having a housing and a fan wheel the fin array comprising:

a first tube in a first plane, wherein the first plane is perpendicular to an axis of the fan wheel;

a second tube in a second plane parallel to the first plane; and a fin in a third plane parallel to the first plane, the fin, the first tube and the second tube partially surrounding the axis of the fan wheel, the fin having a first end and a second end, the fin having a length between the first end and the second end, wherein the first tube and the second tube are in parallel contact with the fin along most of the length of the fin, wherein the fin is sandwiched between the first tube and the second tube, wherein the axis of the fan wheel is perpendicular to a plane defined by a larger surface of the fin, wherein the first tube and the second tube are biased toward an edge of the fin farthest from the fan wheel, and wherein the larger surface of the fin is disposed primarily radially inward of the first tube and the second tube.

2. The fin array of claim 1, wherein the fin occupies a space between an exterior of the fan wheel and the housing.

3. The fin array of claim 1, wherein the fin is perpendicular to and wraps around a portion of an axis of the centrifugal fan approximately the same extent as the housing, and wherein the first tube and the second tube are configured to form at least a portion of a contiguous outer wall of the centrifugal fan.

4. The fin array of claim 1, wherein the first tube and the second tube are configured to respectively contain a first and a second fluid at the same time, wherein the first fluid is not the second fluid.

5. The fin array of claim 1, further comprising: a plurality of fins and tubes, wherein the plurality of fins and tubes are stacked continuing a pattern of the first tube, the fin and the second tube.

6. The fin array of claim 5, wherein every other tube in the plurality of tubes is configured to transport a first fluid while the remaining tubes are configured to transport a second fluid.

7. The fin array of claim 1, wherein the larger surface of the fin is narrow on the first end and progressively widens to the second end, wherein the second end extends inward a greater distance along a plane perpendicular to the axis of the fan wheel than the first end.

8. The fin array of claim 7, wherein a height of the second end of the fin is substantially the same as a vertical height of an exit of the housing.

9. The fin array of claim 1, wherein the height of the second end of the fin is less than half a vertical height of an exit of the housing.

10. A heat exchanger for use in a centrifugal fan having, a housing, a fan wheel, an air entrance, and an air exit, wherein the heat exchanger comprises:

a plurality of tubes and a plurality of fins forming a shape similar to the housing of the centrifugal fan, wherein the plurality of tubes are on an outside edge of the fins following the shape similar to the housing, wherein an inside edge of the plurality of fins is configured to substantially follow an outer circumferential profile of the fan wheel, wherein the plurality of tubes comprises a first tube and a second tube, wherein the fin is sandwiched between the first tube and the second tube, wherein the inside edge and the outside edge of each fin define the radially inward and radially outward bounds of a larger surface of each fin, wherein the larger surface of each fin is disposed primarily radially inward of the plurality of tubes and extends radially inward toward an axis of the fan wheel.

11. The heat exchanger of claim 10, wherein the tubes and the fins form the housing of the centrifugal fan.

12. The heat exchanger of claim 10, wherein each tube of the plurality of tubes is configured to contain a different fluid at the same time as the tubes on either side of the each tube.

13. The heat exchanger of claim 10, wherein the larger surface of the fin is narrow on a first end and progressively widens to a second end.

14. The heat exchanger of claim 10, wherein a height of a second end of the fin is substantial the same as a vertical height of the air exit.

15. The heat exchanger of claim 10, wherein a height of a second end of the fin is less than half a vertical height of the air exit of the housing.

16. The heat exchanger of claim 10, wherein each tube of the plurality of tubes is configured to flow a fluid in an opposite direction as the tubes on either side of the each tube.

17. The heat exchanger of claim 10, wherein each of the plurality of tubes is in contact with each of the plurality of fins along most of the fin's length.

18. The heat exchanger of claim 10, wherein the heat exchanger is configured to pull air into the centrifugal fan by the fan wheel and force the air into the housing creating a high pressure as the air is compressed against the plurality of tubes and follows the plurality of tubes and plurality of fins to the air exit, wherein the plurality of fins are configured to exchange heat with the air as the air passes along the plurality of fins to the air exit.

19. A fin array for use in a centrifugal fan having a housing and a fan wheel, the fin array comprising:

a first tube;

a second tube; and a fin having a first end and a second end, wherein the first tube and the second tube are in parallel contact with the fin along most of the fin's length, wherein the fin is sandwiched between the first tube and the second tube, wherein the fin, the first tube, and the second tube are substantially annular about an axis of the fan wheel, wherein the first tube and the second tube are biased toward an edge of the fin farthest from the fan wheel, and wherein a height of the second end of the fin is selected from a group consisting of:

substantially the same as a vertical height of an exit of the housing, and less than half the vertical height of the exit of the housing.

* * * * *